US007343964B2

(12) United States Patent
Rudy et al.

(10) Patent No.: US 7,343,964 B2
(45) Date of Patent: Mar. 18, 2008

(54) ANTI-VIBRATION TUBE SUPPORT

(75) Inventors: Thomas M. Rudy, Warrenton, VA (US); Amar S. Wanni, Falls Church, VA (US); Marciano M. Calanog, Stafford, TX (US)

(73) Assignee: ExxonMobil Research & Engineering Company, Annandale, NJ (US)

( * ) Notice: Subject to any disclaimer, the term of this patent is extended or adjusted under 35 U.S.C. 154(b) by 0 days.

(21) Appl. No.: 11/253,815

(22) Filed: Oct. 20, 2005

(65) Prior Publication Data

US 2006/0108106 A1 May 25, 2006

Related U.S. Application Data

(60) Provisional application No. 60/630,010, filed on Nov. 22, 2004.

(51) Int. Cl.
*F28D 7/00* (2006.01)

(52) U.S. Cl. ..... 165/162; 248/68.1; 165/165; 165/172

(58) Field of Classification Search ..... 165/162, 165/165, 172; 138/106, 107, 115–117, 112; 248/68.1

See application file for complete search history.

(56) References Cited

U.S. PATENT DOCUMENTS

| | | | | |
|---|---|---|---|---|
| 2,317,572 | A * | 4/1943 | Whitt et al. | 165/69 |
| 3,176,762 | A | 4/1965 | Greenwood et al. | |
| 3,474,513 | A | 10/1969 | Allingham | |
| 3,540,531 | A | 11/1970 | Becker | |
| 3,933,583 | A | 1/1976 | Jabsen | |
| 4,160,477 | A | 7/1979 | Roffler | |
| 4,175,003 | A | 11/1979 | Beuchel et al. | |
| 4,359,088 | A | 11/1982 | Jabsen | |
| 4,570,703 | A | 2/1986 | Ringsmuth et al. | |
| 4,594,216 | A * | 6/1986 | Feutrel | 376/442 |
| 4,648,442 | A | 3/1987 | Williams | |
| 4,781,884 | A | 11/1988 | Anthony | |
| 4,860,697 | A | 8/1989 | Malaval | |
| 4,919,199 | A | 4/1990 | Hahn | |
| 5,072,786 | A | 12/1991 | Wachter | |
| 5,213,155 | A | 5/1993 | Hahn | |
| 6,401,803 | B1 | 6/2002 | Hahn | |

FOREIGN PATENT DOCUMENTS

| | | |
|---|---|---|
| BE | 784438 A1 | 12/1972 |
| GB | 1017455 A | 1/1966 |
| NL | 7811026 A | 5/1980 |

OTHER PUBLICATIONS

International Search Report and Written Opinion for PCT/US 2005/042177.

* cited by examiner

*Primary Examiner*—Teresa J. Walberg
(74) *Attorney, Agent, or Firm*—Glenn T. Barrett

(57) ABSTRACT

A support device for supporting a plurality of elongated members. The support device having a longitudinally extensive strip having a plurality of sets of transverse corrugations located at successive longitudinal locations along the strip. Each set of transverse corrugations forming a plurality of elongated member engaging zones extending laterally outwards from both faces of the strip to engage the elongated members in the tube bundle on opposite sides of a tube lane. The support device is useful to support elongated members in a bundle and to mitigate the possibility of damage from flow-induced vibration in elongated members.

24 Claims, 3 Drawing Sheets

ANTI-VIBRATION TUBE SUPPORT

CROSS REFERENCE TO RELATED APPLICATION

This application relates and claims priority to U.S. Provisional Patent Application No. 60/630,010, filed on Nov. 22, 2004, entitled "Anti-Vibration Tube Support." The contents of which are specifically incorporated herein by reference.

FIELD OF THE INVENTION

This invention relates to tube support devices, commonly referred to as tube stakes. The tube support devices are installed to control flow-induced vibration and prevent movement of the tubes or rods within the bundle. The tube support devices may be retrofitted into existing tube or rod bundles or installed in new bundles. The present invention is useful with tube bundles in heat exchangers, cooling towers, steam generators and similar fluid-handling equipment It is contemplated that the present invention may be used in any application where vibration caused by fluid flow across a pattern of elongated members (tubes, pipes, rods, etc.) presents a problem.

BACKGROUND OF THE INVENTION

Tube bundle equipment such as shell and tube heat exchangers and similar items of fluid handling devices utilize tubes organized in bundles to conduct the, fluids through the equipment. In such tube bundles, there is typically fluid flow both through the insides of the tubes and across the outsides of the tubes, The configuration of the tubes in the bundle is set by the tube sheets into which the tubes are set. One common configuration for the tubes is the rectangular formation with the tubes set in aligned rows with tube lanes (the straight paths between the tubes) between each pair of tubes or rows of tubes, aligned orthogonally to one another. In this formation, each tube is adjacent to eight other tubes except at the periphery of the tube bundle and is directly opposite a corresponding tube across the tube lane separating its row from the two adjacent rows. In the triangular tube formation, the tubes in alternate rows are aligned with one another so that each tube is adjacent six other tubes (the two adjacent tubes in the same row and four tubes in the two adjacent rows).

Fluid flow patterns around the tubes as well as the changes in the temperature and density of the fluids which arise as the fluids circulate within the heat exchanger may give rise to flow-induced vibrations of an oscillatory nature in the tube bundle. If these vibrations reach certain critical amplitudes, damage to the bundle may result. Tube vibration problems may be exacerbated if heat exchange equipment is retubed with tubes of a different material to the original tubes, for example, if relatively stiff materials are replaced with lighter weight tubes. Flow-induced vibration may also occur when equipment is put to more severe operating demands, for example, when other existing equipment is upgraded and a previously satisfactory heat exchanger, under new conditions, becomes subject to flow-induced vibrations. Vibration may even be encountered under certain conditions when an exchanger is still in the flow stream but without beat transfer talking place.

Besides good equipment design, other measures may be taken to reduce tube vibration. Tube support devices or tube stakes as these support devices are commonly known (and referred to in this specification) may be installed in the tube bundle in order to control flow-induced vibration and to prevent excessive movement of the tubes. A number of tube supports or tube stakes have been proposed and are commercially available. One type, described in U.S. Pat. No. 4,648,442 to Williams has a U-shaped configuration in which the distance between the top and bottom surfaces of the channel is the same as the distance between adjacent rows in the tube bundle (i.e. substantially the same as the tube lane dimension). This type of stake is inserted between the rows in the bundle and is secured at end by an arcuate segment which engages a segment of a tube at the periphery of the tube bundle so as to lock the stake in place in its appropriate position between the rows in the bundle. Stakes of this type are typically made of a corrosion-resistant metal, for example, type 304 stainless steel with a thickness between 0.7 and 1.2 mm to provide both the necessary rigidity for the staked tube bundle as well as sufficient resilience in the U-shaped channel to allow the stakes to be inserted into the lanes between the tubes in the bundle.

Another form of anti-vibration tube stake is described in U.S. Pat. No. 4,919,199 to Hahn which discloses a stake made in a soft V-configuration strip in which saddles are formed perpendicular to the longitudinal axis of the strip in the open ends of these V-shaped cross sections. The saddles are formed in the strip with a pitch (distance between saddles) equal to the tube pitch and with a radius which matches that of the tubes in the tube bundle so the saddles engage with the tubes on one side of the tube lane. The engagement between these tubes and the saddles locks the tube into place in the tube bundle. The resilient nature of the strip, coupled with the spring type action provided by the V-configuration permits the arms of the V to open and reduce the effective overall width of the stake enables the stake to engage the tubes on both sides of a tube lane in so-that the V-shaped stake is locked into place between the two rows of tubes.

A similar type of tube stake is described in U.S. Pat. No. 5,213,155 to Hahn which discloses a U-shaped stake which is inserted between two tube, lanes with the closed end of the U over one of the peripheral tubes in the bundle. Saddles are formed in the open ends of the V-shaped cross section to engage with opposite sides of the tubes in a single row in the bundle. The U-shaped stake is fastened in place around the tubes of the bundle by suitable fasteners extending between the two arms of the stake.

One problem with the pressed configuration of the type shown in U.S. Pat. No. 4,648,442 is that the stakes do not create a positive location for each individual tube, although the stake is locked into place in its selected tube lane. The tubes remain free to vibrate in one plane parallel to the tube lane and parallel to the stake. A different problem exists with the design shown in U.S. Pat. No. 5,213,155: although the tubes in rows encircled by the U-shaped stakes are fully supported, the tubes at the periphery of the tube bundle which are not directly encircled by one of the stakes i.e., retained within one of the closed ends of the U-shaped stakes (these are the outer tubes in alternate rows which are not encircled by the ends of the U-shaped stakes), are free to move and vibration in these tubes can be expected under certain conditions. In addition, because the corn on of the tube support has a transition region before reaching its full depth the two tubes adjacent to each of the outermost tubes do not receive any vibration mitigation either.

One disadvantage of the stake designs which use channel pressings to accommodate the distance between the tubes forming a single tube lane is that deep channel pressings are required or other measures necessary when the tube lane is relatively wide. A more complicated form of tube support is shown in U.S. Pat. No. 6,401,803 to Hahn. This stake uses two V-shaped pressings separated by compression springs which force the stakes against the tubes on opposite sides of the tube lane in order to dampen oscillatory vibrations. This form of stake is, however, quite expensive to manufacture. A unitary stake, which will accommodate relatively wide tube lanes without the complication of separate parts therefore, remains desirable.

SUMMARY OF THE INVENTION

According to an aspect of the present invention, a tube support device or tube stake which is useful to mitigate the possibility of tube damage from flow-induced vibration in tube bundles or rods comprises an elongated member or strip which is intended to be inserted in a tube lane between the tubes or rods of a tube bundle in a heat exchanger, condenser, cooling tower or other tube bundle device. Raised-tube-engaging zones are disposed along the length of the strip; these tube-engaging zones are formed by transverse corrugations which extend laterally out from-both faces of the strip, away from the medial plane of the strip, to engage with tubes on opposite sides of the tube lane into which the stake is inserted. The raised-tube-engaging zones may be located at successive longitudinal locations or substantially along the entire length of the strip or stake. The corrugations are preferably arranged so that they extend laterally out from the two opposed faces of the strip in an alternating manner, first from one face of the strip and then the other.

The tube stakes maybe used in both conventional tube formations, either the rectangular formation or the triangular tube formation. The stakes may be inserted into each tube lane or into alternate rube lanes. When inserted into each tube lane, the tubes receive support from stakes on both sides. Because the effective gap between the tubes (tube lane dimension) is smaller with the triangular formation the thickness as well as the height of the raised tube-engaging zones will normally be smaller in order for the stake to be inserted between the tube lanes with this-configuration. The tube stakes may be used in new tube bundles or retrofit into existing bundles. The flexibility of the stakes permit the tube stakes to be inserted into both rectangular and triangular configurations. The stakes can also be used in applications where the spacing between the tubes is not clearly defined due, for example, to the warping of the existing tubes.

The tube stakes of the present invention may be conveniently and inexpensively fabricated by pressing with dies equipped with suitably arranged protrusions and cavities to form the corrugations or other forms of tube-engaging zones or by the use of pairs of rollers which have protrusions and cavities (alternating between the top and bottom rollers of the set) to form the raised zones on the strip. Many of the known types of tube stake, as discussed above, for example, do not lend themselves to this economical and convenient method of fabrication.

It is an aspect of the present invention to provide a support device for a plurality of elongated members. The plurality of elongated members are arranged in rows with spacer lanes separating adjacent rows of elongated members. It is contemplated-that the plurality of elongated members can be arranged in various configurations. The support device includes an elongated longitudinally extending strip having a pair of opposing faces. The strip has a plurality of sets of transverse corrugations located at successive longitudinal locations along the strip or a continuous set of corrugations located substantially along the entire length of the support device. In accordance with the present invention, each set of transverse corrugations forms at least one elongated member engaging zone extending laterally outward away from at least one of the pair of opposing faces to engage at least one of the plurality of elongated members. Each of the set of transverse corrugations may form a plurality of elongated member engaging zones. The plurality of elongated member engaging zones extend laterally outwards from the opposing faces to engage elongated members on opposing sides of the spacer lane. The corrugations in each set of transverse corrugations may form alternating elongated member engaging zones on opposing faces of the strip. In accordance with an aspect of the present invention, each corrugation may have a depth that is greater than the width of the spacer lane. The transverse corrugations may cause displacement of at least one of the elongated members when the at least one elongated member engaging zone engages at least one of the plurality of elongated members. The support device may further include an engagement assembly on at least one end of the strip to temporarily engage the strip for locating the strip within the spacer lane.

It is another aspect of the present invention to provide a tube support device for a tube bundle having a plurality of elongated tubes. The plurality of elongated tubes are arranged in rows with tube lanes separating adjacent rows of elongated tubes. The tube support device may include an elongated longitudinally extending strip having a pair of opposing faces. The strip is adapted to be located within one tube lane. The strip has a plurality of sets of transverse corrugations located at successive longitudinal locations along the strip. Each set of transverse corrugations may form at least one tube engaging zone extending laterally outward away from at least one of the pair of opposing faces to engage at least one of the plurality of elongated tubes. Each set of transverse corrugations may form at a plurality of tube engaging zones. The plurality of tube engaging zones extend laterally outwards from the opposing faces to engage the tubes on opposing sides of the tube lane. The corrugations in each set of transverse corrugations may form alternating tube engaging zones on opposing faces of the strip. Each corrugation may have a depth that is greater than the width of the tube lane. The transverse corrugations cause displacement of at least one of the tubes when the at least one tube engaging zone engages at least one of the tubes.

In accordance with another aspect of the present invention, at least one of the tube support devices is incorporated into a tube bundle device.

BRIEF DESCRIPTION OF THE DRAWING

The invention will now be described in connection with the following drawing in which like reference numerals designate like elements and wherein.

DETAILED DESCRIPTION OF THE INVENTION

The tube support device or tube stake of the present invention is arranged to provide direct support for tubes or rods or pipes which are adjacent to one another but on opposite sides of a tube lane. The tube stake may be inserted between the tubes in the tube bundle along a tube lane between adjacent tube rows. It is contemplated that the tube support device may be inserted into a tube lane in an existing tube bundle. The corrugations formed in the tube stoke permit a certain amount of flexing of the tube stake such that the stake may be fed through a tube lane that is not clearly defined, which may be due to the warping of the tubes or elongated members. It is also contemplated that the tube support device may be positioned in a tube lane during assembly of the tube bundle. While the present invention is described in connection with tubes or rube bundles, it is not intended that the present invention be used solely with cylindrical, hollow tubes. It is intended that the present invention may be used with hollow or solid rods or tubes. Furthermore the tubes are not limited to a circular cross section; rather, it is intended that the tubes may have a square, triangular or other configuration. Where the construction of the exchanger permits, the stake may be made sufficiently long to extend from one side of the tube bundle to the other to provide support for the tubes across the entire width of the bundle; in this case, the length of the rube stakes will vary according to the length of the tube lanes across the bundle. In many cases, however, the location of pass lanes in the bundle will create discontinuities in the lanes so that it will not be possible to insert the stakes all the way across the bundle. In such cases, it may be possible to insert the stakes into the bundle from different angles along the length of the bundle in order to provide as much support as possible for the tubes. Thus, the stakes will be inserted transversely into the bundle at each axial location in an angularly variant direction (at a different angle in The transverse plane of the tubes) from the direction of insertion at the next axially adjacent location. This may, however, leave the tubes without staked support in some parts of the bundle, normally in the middle of the bundle where access from the periphery is precluded. In view of their simple and repetitive configuration, the present tube stakes may be readily cut to the desired length to fit the bundle, whether extending entirely across it or only part of the way. If desired for extra rigidity, the stakes may be tied together around the periphery of the tube bundle, for example, by bending over the ends of the stakes to form ear, which can then be riveted or otherwise locked onto a girth band encircling the tube bundle. The stakes may be secured together using, for example, a cable or other suitable fastener. The cable may be fed through a hole 17 in the end of a tube stake 10.

Figure 1:
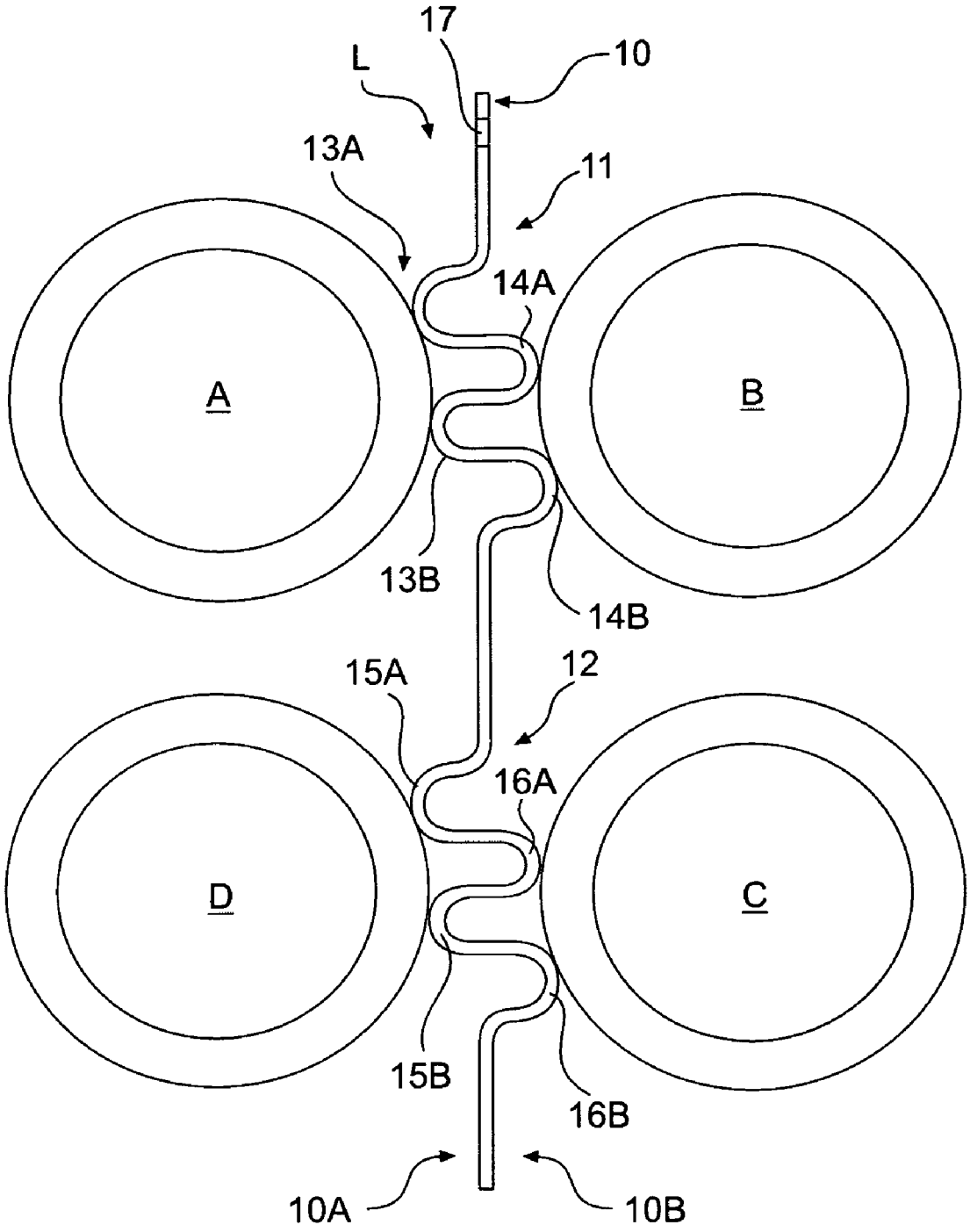
FIG. 1 is a schematic view of an anti-vibration tube support arranged between four tubes in a rectangular arrangement heat exchanger according to an embodiment of the present invention.
Figure 2:
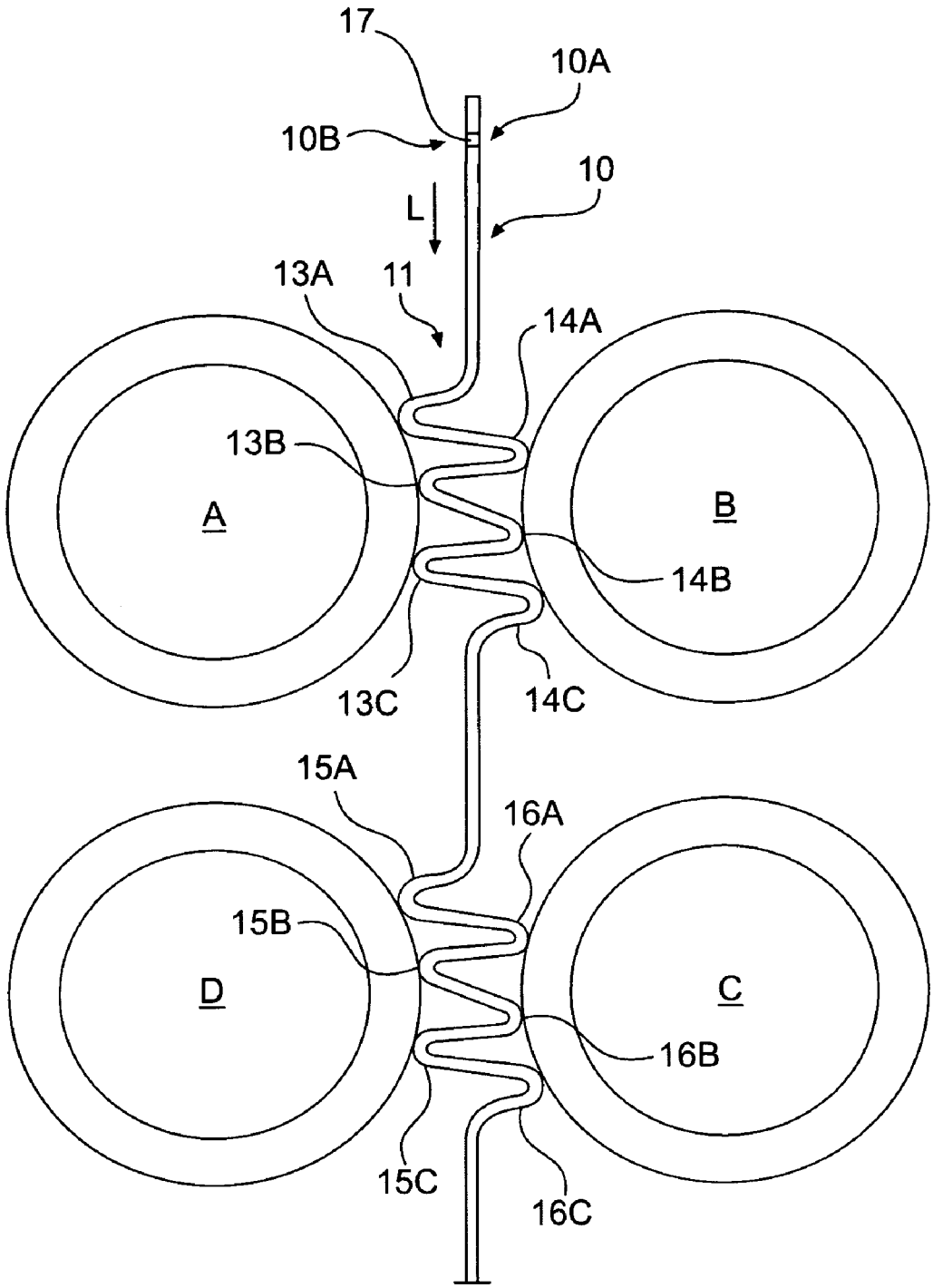
FIG. 2 is a schematic view of a variation of the anti-vibration tube support of FIG. 1.

FIGS. 1 and 2 show four adjacent tubes A, B, C, and D in a tube bundle with a rectangular tube formation. A tube support device or tube stake 10 according to the present invention is inserted into a spacer lane or tube lane L between two rows of tubes. Tube state 10 may be formed from a strip of metal or other suitable material that is capable of withstanding corrosion due to prolonged exposure to fluids and the temperatures present in the heat exchanger. The tube stake 10 extends in tube lane L defined by tubes A and D on one side of the lane and tubes B and C on the other side of the tube lane. Of course, in the complete tube bundle, there will be additional tubes extending in the row formed by a continuation of the tube row containing tubes A, D and another row continuing on from tubes B and C, with other tube rows arranged in similar conventional manner making up the tube bundle. The tube lanes between these two adjacent rows and other adjacent rows of tubes will be similarly extensive across the tube bundle. Tube stake 10 has tube-engaging zones 13,14,15,16 formed by transverse corrugations, which extend alternately out from the two faces of the strip. A first set of transverse corrugations 11 extends out from faces 10A and 10B of the strip to engage with tubes A and B while a second set of corrugations 12 extend out from faces 10A and 10B of the strip to engage with tubes C and D. Successive sets of corrugations will be formed at other locations along the length of the strip to engage in a similar manner with other opposing tubes at their respective locations. In the first set of corrugations, the tube-engaging portions are formed by the tips or extremities 13A, 13B of the corrugations on one side of the strip 10A and the tips or extremities 14A, 14B on the other side 10B, as shown in FIG. 1. Tips 13A, 13B engage with tube A and tips 14A, 14B engage with tube B. In a similar manner, tips 15A, 15B engage with tube D and tips 16A, 16B with tube C. While two tips or extremities are shown in FIG. 1, the present invention is not intended to be so limited; rather, it is contemplated that at least three extremities or tips (e.g., 13A, 13B, 13C, as shown in FIG. 2) may be provided.

Figure 3:
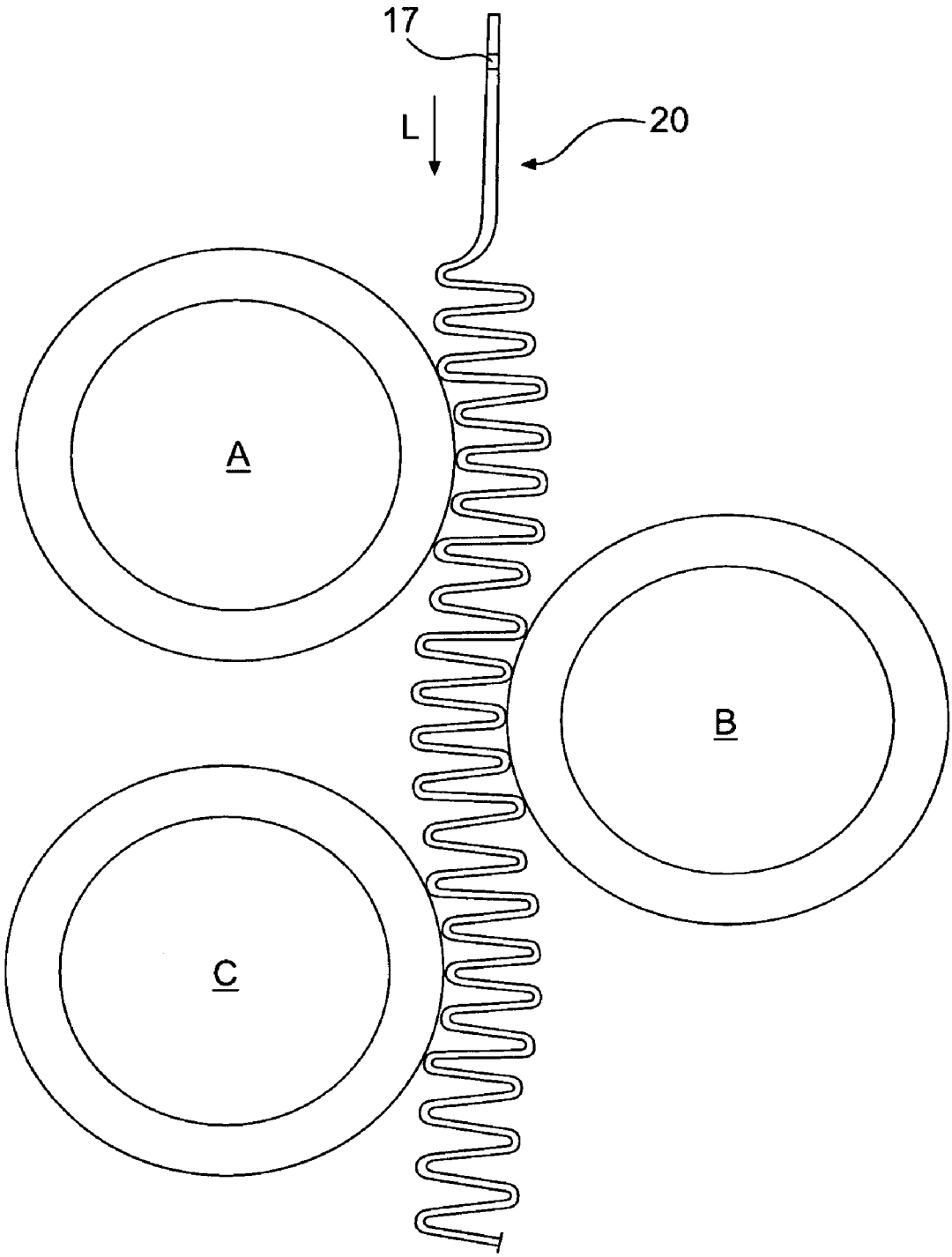
FIG. 3 is a schematic view of an anti-vibration tube support arranged between three tubes in a triangular arrangement heat exchanger in accordance with another embodiment of the present invention.

It is also contemplated that the corrugations that form the tips or extremities may run substantially the entire length of the tube stake 20, as shown in FIG. 3. It is also contemplated that the corrugations may extend along only a portion (e.g. outer portion) of the stake. The corrugations may be combined with other arrangements, as disclosed, for example, in U.S. patent application Ser. No. 10/848,903 to Wanni et al. entitled "Anti-Vibration Tube Support," the contents of which are incorporated herein by reference. For example, The placing of the transverse rows of raised, tube-engaging zones on the tube stake are to provide the desired engagement between the tube stake and the tubes in the tube bundle with which they are being used. To accommodate pass lanes in the tube bundles, the distances between successive sets of corrugations may be increased or decreased correspondingly, consistent with the arrangement of tubes in the bundle. It is contemplated that the corrugations may run substantially the entire length of the tube stake 20, as shown in FIG. 3. Such an arrangement is particularly useful when the spacer lane or tube lane is not clearly defined.

Typically, the total depth of the corrugations from one tip to an opposite tip will be from 0.5 to 2 mm, preferably 0.5 to 1.5 mm, greater than the spacing between the tubes at the point where tube engagement occurs so that a tube deflection of similar magnitude is achieved at this point. It is contemplated that the height of each corrugation may vary. The exact deflection achieved in practice will be less than the total depth of the stake because the tubes nest into the valleys of the corrugations to a certain extent, as shown in the figure where tube A, for example, nests into the valley between tips 13A and 13B. Clearly, the extent to which the tube is accommodated into the valleys and the extent to which it sits on top of the tips will depend on the respective geometries, including tube diameter, tube shape, pitch and spacing and corrugation pitch (distance between successive tips in a set) and depth. This may best be determined on an empirical basis. To a certain extent, therefore, the tube-engaging zones formed by the corrugations will fit around the tubes so that the tip-to-tip distance will not represent accurately the separation which will be induced in the tubes but this corrugation depth will normally be found suitable to give a tube deflection which provides good support and vibration resistance and results in a very rigid tube bundle.

The elasticity of the stake itself as the corrugations deform around the tubes and the elasticity of the tubes, coupled with engagement between the raised tube-engaging zones and the tubes will not only make the tubes more resistant to vibration but also retain the stake in place in the bundle. Desirably, the total depth of the tube-engaging zones (the tip-to-tip distance including strip thickness is selected so that each stake deflects the unsupported tube (i.e. when not supported by a stake on the opposite side) from its rest position with a minor tube deflection, typically about 0.5 to 2 mm. This is a feature of the present type of stake which permits the use of a smaller number of stakes than has been customary, typically, about 50% fewer than would otherwise be needed. One advantage of the present type of tube stake is that relatively wide tube lanes can be accommodated without deep pressing of the strips since about half the tube lane dimension is taken up on each side of the strip.

In addition to the total depth of the stake, the thickness and stiffness of the material of the strip will be factors in fixing the final tube deflection when the stakes are inserted into the bundle. Normally, a strip thickness of from 1 to 2 mm will be satisfactory to provide adequate tube support and ability to resist the stresses of insertion into the bundle.

FIGS. 1 and 2 show the tube stake 10 in place in a rectangular tube formation for which configuration it is better suited. The tube stake 10 may also be used in a triangular configuration. FIG. 3 shows the tube stake 20 in place in a triangular tube formation. The arrangement shown in FIG. 3 is better suited for applications where the tubes may not line up uniformly or when the spacing between the tubes varies. It is contemplated that either stake 10 or 20 may be used in either a rectangular or triangular configuration provided at least one or more of the corrugations contact the adjacent tube to provide support for the same.

Because the effective gap between the tubes (tube lane dimension) in the triangular tube formation is smaller than that of the rectangular formation, the plate thickness as well as the total depth of the corrugations (peak to valley, including plate thickness) will typically be smaller than that for the rectangular arrangement but the same amount of tube deflection is suitable for adequate tube support and stake retention. In the same way as described above, the tube stake may be inserted into the tube lane between the tubes and pushed or pulled into place until engagement with the tubes on both sides of the tube lane with retention of the stake maintained by the elasticity of the metal and by the tube-engaging zones on the stake.

When the tube support stakes are inserted into the tube bundle, corrugations forming the tube-engaging zones have to be pushed or pulled past the tubes until the stake is in its proper place in the bundle. A spreader bar may be used to temporarily increase the space between the tubes to aid in the insertion of the stakes 10 or 20. Each set of corrugations has to be pushed or pulled through the gap formed by the tube lane until the stake is in place. Pulling the stakes into place is a useful option with this type of stake since the tension on the stake will tend to flatten out the corrugations so that the stake will slip into place more easily into the bundle. Then, when the tension is relieved, the stake will revert to its original configuration and the corrugations will engage the tubes tightly in the intended manner. To facilitate pulling the tubes into position, the strip may be provided at one or both ends with means for temporarily engaging the strip with an elongated tensioner which can be inserted between the tubes in the bundle and engaged with the end of the strip; the stake can then be drawn into the bundle under until it is in its intended position, at which time the tension can be slacked off and the tensioner disengaged from the strip, leaving the corrugations to relax into their original configuration, holding snugly to the tubes. The engaging means on the strip may suitably be a hole 17 at the end of the strip or a hook formed on the end of the strip by bending the end around. The tensioner may suitably be a pulling rod with a hooked end or a wire which may be engaged with the stake e.g. with a latch, to pull it through the bundle into its correct place. A tensioner rod used as a pulling means may suitably have an L-shaped end to engage with a hook on the end of the strip or, alternatively, a wire loop can-be threaded through a hole in the strip to exert the pulling force on the stake as it enters the bundle. Because the total depth of the tube engaging zones (tip-to-tip, including plate thickness) is preferably slightly greater than the width of the tube lane, the tubes have to bend slightly to let the corrugations pass; although this maintains the stake in place when it is in its final position, it makes insertion that much more difficult as the resistance to bending of each row of tubes has to be overcome. The stake used with the rectangular configuration is generally easier to insert than the stake used with the triangular configuration because the second type of stake has the corrugations at closer intervals along the length of the stake than the first and, being transverse corrugations, they tend to allow the stake to spring together under the influence of the insertion force applied at the outer end and the resistance from the far end of the stake and along its inserted length; obviously, the problem is exacerbated the further the stake is inserted into the bundle. Insertion of the tube stakes into the tube bundle may, however, be facilitated by first inserting a spreader bar with beveled edges having a thickness that is slightly greater than the total depth of the stake (including the corrugations or other raised zones) after which the stake is inserted into place and the metal bar is slowly removed to ensure the proper locking in of the tubes and the tube stake. The bar may also be used in a similar manner to facilitate removal of the stakes.

The transverse corrugations may be combined with other tube-engaging zones such as the dimples, longitudinal corrugations or merged dimples/corrugations, all as described in co-pending U.S. application Ser. No. 10/848,903 to Wanni et al., filed on May 19, 2004, entitled "Anti-Vibration Tube Supports," the contents of which are specially incorporated herein by reference, or saddles, as described in co-pending U.S. patent application Ser. No. 11/128,884 to Wanni et al., filed on May 13, 2005, entitled "Anti-Vibration Tube Support," the contents of which are specially incorporated herein by reference. The longitudinal corrugations are likely to be particularly useful in deep tube bundles in which the stakes have to be inserted past a relatively large number of tubes with a corresponding increase in tube/stake forces during insertion. The use of the longitudinal corrugations at the inner end of the stake can enable the stake to be pushed or pulled into the bundle with greater ease, while the transverse corrugations at the outer end of the stake will hold it in its intended place in the bundle as the transverse corrugations are finally located relative to the tubes at the outer periphery of the bundle. With this type of stake, it is in fact possible to make the longitudinal corrugations continuous along their length to facilitate the insertion of the stake into the bundle as there are no notches between the ends of adjacent corrugations to catch upon the tubes as the stake enters the bundle. Retention of the stake is then provided by the transverse corrugations at the outer end of the stake. The corrugations are preferably arranged so that they extend out alternately across the strip, from each face of the strip, as described in the earlier application. If stakes of this type are to be inserted into the tube bundle under tension, the temporary engagement device for the tensioning device will be at this end of the strip.

The stakes may be inserted at axial locations detained by experience or by vibration studies for the relevant equipment. The stakes may be inserted into the bundle in different transverse directions at different axial locations, for example in a vertical direction at the first axial location, in the horizontal at the second location, followed in alternate sequential manner at successive axial locations along the length of the tube bundle. The stakes may be inserted into the bundle and then pivoted into the desired location.

As can be seen from the drawings, each tube stake engages with tubes on opposite sides of a tube lane so that insertion of a stake in each tube lane provides support for two rows of tubes within the outer periphery of the tube bundle. At the periphery of the bundle some tubes may receive support from a stake which does not support a tube on the other side. This reduces the effective support given to those tubes but since the length of stake extending out from the last pair of tubes within the bundle is relatively short, some effective support is given to these outer tubes on one side at least by the cantilevered end of the stake. Using a cable to secure the ends of the stakes 10 or 20, as described above, improves the effective support provided to the tubes near the ends of the stakes.

While the frictional engagement between the stakes and the tubes will provide for retention of the stakes in the bundle, the end of the tube stake may be provided with a tube-engaging crook, to hook over the end of a tube on one side of the tube Jane to prevent withdrawal of the stake in one direction. Alternatively, the stakes may be folded into a U-shaped or hairpin configuration, which has, effectively, a pair of the stakes conjoined at one end by means of an arcuate, tube-engaging segment. This configuration can provide stiffening for either three or four tube rows simultaneously with additional positive location for the stake from the closed end of the hairpin (the arcuate segment) being locked over of the peripheral tubes at one end to the bundle. Because each stake provides stiffening for three or four tube rows simultaneously, the U-shaped tube stakes will be inserted over alternate rows to provide stiffening for each row of tubes in the rube bundle or inserted such that they span two columns of tubes and are inserted into alternate lanes between rows, which would support four adjacent rows. If desired, additional stake retention may be provided by retention members such as bolts extending between the arms of the hairpin at one or more points along its length. Additional locking for single-line stakes (not formed into the U-configuration) may be provided by attaching the ends of the stakes to a metal girth band or cable, which encircles the tube bundle. The stakes may be secured to the band by forming a lug on the end of the band which can be welded, riveted or screwed to the band; alternatively, a small slot or hole can be punched in the end of the stake through which the girth band can be passed. The girth band can be secured; for example, to tie rods that are available in the tube bundle device adjacent to the outer tube circumference of the tube bundle, to reduce the possibility of tube supports sliding down the tubes.

The tube stakes are suitably made of a metal or other suitable material, which will resist corrosion in the environment of the tube bundle device in which it is to be used. Normally, to resist corrosion in both water and other environments, stainless steel will be satisfactory. Stainless SS 304 is suitable except where chloride corrosion is to be expected when duplex stainless steel will be preferred. The duplex stainless steels which contain various amounts of the alloying elements chromium, nickel and optionally molybdenum are characterized by a mixed microstructure with about equal proportions of ferrite and austenite (hence the common designator "Duplex").

Besides its good stake retention capability, another major advantage of the present type of stake is its simplicity. Unlike the stakes shown in U.S. Pat. Nos. 4,919,199 and 5,213,155 which require the metal strip to be formed by pressing in two directions, longitudinally into the U- or V-shaped channel and transversely to formed the tube-receiving saddles, an expensive operation involving large machines in which the press force could be as large as 20 tonnes. The tube-engaging zones of the present stakes, by contrast, can be formed by a single pressing operation in the transverse direction, fabricating several rows of corrugations at a time, with successive pressings along the length of the stake, in a simple press with a low pressing force. The use of two press rolls would, of course, represent be the most economical option for large-scale manufacture but is not necessary and the cheaper, simpler equipment could be used failing access to greater resources.

It will be apparent to those skilled in the art that various modifications and/or variations may be made without departing from the scope of the present invention. Thus, it is intended that the present invention covers the modifications and variations of the insertion, provided they come within the scope of the appended claims and their equivalents.

What is claimed is:

1. A support device for a plurality of elongated members, wherein the plurality of elongated members are arranged in rows with spacer lanes separating adjacent rows of elongated members, the support device comprising:

an elongated longitudinally extending strip having a pair of opposing faces, a width and a longitudinal axis, a plurality of elongated member engaging zones extending laterally outward away from at least one of the pair of opposing faces to engage at least one of the plurality of elongated members, wherein each elongated engaging zone having a plurality of transverse corrugations, wherein each corrugation extends orthogonal to the longitudinal axis across the width of the strip.

2. The support device according to claim 1, wherein the plurality of elongated member engaging zones are arranged in sets of transverse corrugations at successive longitudinal locations along the strip.

3. The support device according to claim 2, wherein the plurality of elongated member engaging zones extend laterally outwards from the opposing faces to engage elongated members on opposing sides of the spacer lane.

4. The support device according to claim 2, wherein the corrugations in each set of transverse corrugations form alternating elongated member engaging zones on opposing faces of the strip.

5. The support device according to claim 1, further comprising an engagement assembly on at least one end of the strip to engage with an orienting device such that the strip can be located within the spacer lane.

6. The support device according to claim 1, wherein each corrugation having a depth, wherein the depth of each corrugation being greater than the width of the spacer lane.

7. The support device according to claim 6, wherein the transverse corrugations causing displacement of at least one of the elongated members when the at least one elongated member engaging zone engages at least one of the plurality of elongated members.

8. The support device according to claim 1, wherein the plurality of transverse corrugations extend substantially along the length of the strip.

9. A tube support device for a tube bundle having a plurality of elongated tubes, wherein the plurality of elongated tubes are arranged in rows with tube lanes separating adjacent rows of elongated tubes, the tube support device comprising:

an elongated longitudinally extending strip having a pair of opposing faces, a width and a longitudinal axis, wherein the strip is adapted to be located within one tube lane, a plurality of tube engaging zones extending laterally outward away from at least one of the pair of opposing faces to engage at least one of the plurality of elongated tubes, wherein each elongated engaging zone having a plurality of transverse corrugations, wherein each corrugation extends orthogonal to the longitudinal axis across the width of the strip.

10. The tube support device according to claim 9, wherein the plurality of elongated member engaging zones are arranged in sets of transverse corrugations at successive longitudinal locations along the strip.

11. The tube support device according to claim 10, wherein the plurality of tube engaging zones extend laterally outwards from the opposing faces to engage the tubes on opposing sides of the tube lane.

12. The tube support device according to claim 10, wherein the corrugations in each set of transverse corrugations form alternating tube engaging zones on opposing faces of the strip.

13. The tube support device according to claim 9, further comprising an engagement assembly on at least one end of the strip to engage with an orienting device such that the strip can be located within the tube lane.

14. The tube support device according to claim 9, wherein each corrugation having a depth, wherein the depth of each corrugation being greater than the width of the tube lane.

15. The tube support device according to claim 14, wherein the transverse corrugations causing displacement of at least one of the tubes when the at least one tube engaging zone engages at least one of the tubes.

16. The tube support device according to claim 9, wherein the plurality of transverse corrugations extend substantially along the length of the strip.

17. A tube bundle device comprising:

a tube bundle having a plurality of elongated tubes, wherein the plurality of elongated tubes are arranged in rows with tube lanes separating adjacent rows of elongated tubes; and at least one tube support device, wherein each tube support device comprising an elongated longitudinally extending strip having a pair of opposing faces, a width and a longitudinal axis, wherein the strip is adapted to be located within one tube lane, a plurality of tube engaging zones extending laterally outward away from at least one of the pair of opposing faces to engage at least one of the plurality of elongated tubes, wherein each elongated engaging zone having a plurality of transverse corrugations, wherein each corrugations extends orthogonal to the longitudinal axis across the width of the strip.

18. The tube bundle device according to claim 17, wherein the plurality of elongated member engaging zones are arranged in sets of transverse corrugations at successive longitudinal locations along the strip.

19. The tube bundle device according to claim 18, wherein the plurality of tube engaging zones extend laterally outwards from the opposing faces to engage the tubes on opposing sides of the tube lane.

20. The tube bundle device according to claim 17, wherein the corrugations in each set of transverse corrugations form alternating tube engaging zones on opposing faces of the strip.

21. The tube bundle device according to claim 17, wherein the tube support device further comprising an engagement assembly on at least one end of the strip to engage with an orienting device such that the strip can be located within the tube lane.

22. The tube bundle device according to claim 17, wherein each corrugation having a depth, wherein the depth of each corrugation being greater than the width of the tube lane, wherein the transverse corrugations causing displacement of at least one of the tubes when the at least one tube engaging zone engages at least one of the tubes.

23. The tube bundle device according to claim 17, wherein the plurality of transverse corrugations extend substantially along the length of the strip.

24. The tube bundle device according to claim 17, wherein the tube bundle device is a heat exchanger.

* * * * *